United States Patent [19]

Roeder et al.

[11] 4,192,488

[45] Mar. 11, 1980

[54] MACHINE MOUNTED TORCH

[75] Inventors: Georg Roeder; Helmut Sachs, both of Frankfurt am Main; Dieter Hajok, Hattersheim, all of Fed. Rep. of Germany

[73] Assignee: Messer Griesheim GmbH, Frankfurt am Main, Fed. Rep. of Germany

[21] Appl. No.: 29,359

[22] Filed: Apr. 11, 1979

[30] Foreign Application Priority Data

Apr. 29, 1978 [DE] Fed. Rep. of Germany ..... 2819073

[51] Int. Cl.[2] ..... B23K 7/00

[52] U.S. Cl. ..... 266/77; 266/48

[58] Field of Search ..... 266/48, 77

[56] References Cited

U.S. PATENT DOCUMENTS

| | | | |
|---|---|---|---|
| 3,642,266 | 2/1972 | Diehl et al. | 266/48 |
| 3,677,515 | 7/1972 | Fassler | 266/48 |
| 3,948,496 | 4/1976 | Miller | 266/48 |

*Primary Examiner*—W. Stallard

*Attorney, Agent, or Firm*—Connolly and Hutz

[57] ABSTRACT

A machine mounted torch includes a torch head to which a nozzle is exchangeably fastened by a holding device wherein two oppositely disposed support surfaces are provided for holding counter surfaces of a spring loaded bushing which holds the nozzle.

11 Claims, 7 Drawing Figures

10
12
22
24
26
20
30
28
70
74
32
34
36
80
14
55
53
40
38
55
72
16
54

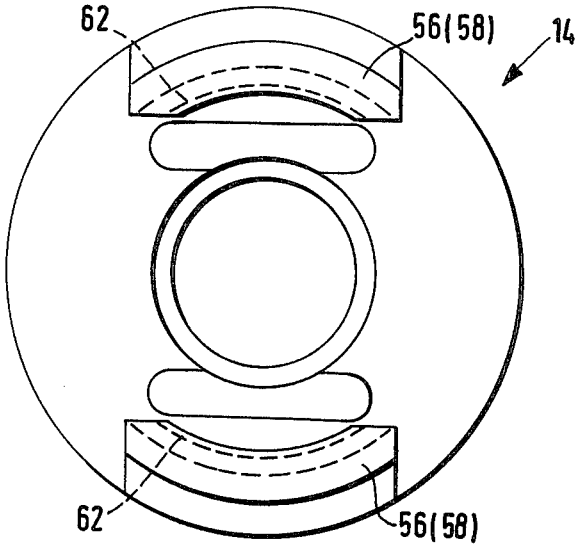
FIG.3
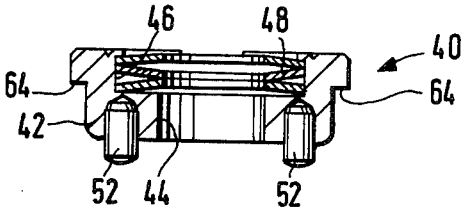
FIG.4a
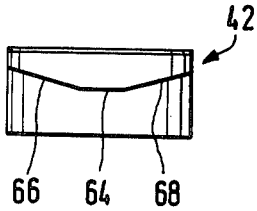
FIG.4b
FIG.4
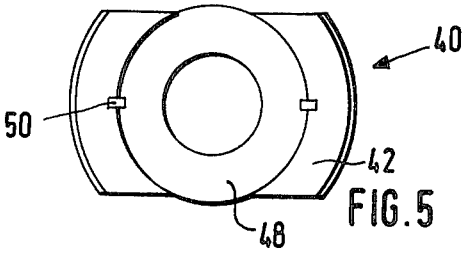
FIG.5

MACHINE MOUNTED TORCH

BACKGROUND OF INVENTION

The present invention relates to a machine mounted torch, particularly machine mounted cutting torches or marking torches etc., consisting of a torch body with one end of which the torch is arranged in a machine mounting and on the other end of which a nozzle is exchangeably fastened by means of holding device.

It is known in the state of the art to fasten a nozzle to a torch body by means of a set screw or a clamping nut. This type of fastening is used as a rule for small nozzles as is, for example, the case for acetylene hand welding or cutting torches.

It is, however, more difficult to fasten nozzles to machine mounted torches which can, in accordance with their size, often only be fastened by means of large nuts (for example, wrench opening 22 and more) to the torch body. Since for this purpose large wrenches with wrench openings of 28 and more must be used, this type of fastening is, especially for multi-torch aggregates, a problem because of the constructively available limited narrow space. In order to solve this problem, it was already proposed (German Patent No. 2,433,870) to use a holding device (clamping bolt) on the torch head by means of which the nozzle can be quickly and especially simply screwed to the torch body and, to be sure, independent of the nozzle size by means of relatively small screws.

In this known way of "nozzle clamping" (German Patent No. 2,433,870), it can happen that the nozzle to be fastened is slightly displaced with respect to the torch axis, in other words, is fastened at an angle as a result of uneven tightening of the screws over the clamping device.

As a result, leakage may occur in the connecting zone between nozzle and torch body.

SUMMARY OF INVENTION

Based on the above described state of the art, it is the object of the present invention to improve the already known nozzle fastening to torch bodies in such a way that at all times a perfect axis-parallel alignment of the nozzle with the torch body is guaranteed and that only an optimal seal between nozzle and torch body is, therefore, obtained, but also a perfect transfer of the gas from the torch body to the nozzle.

In order to accomplish the above mentioned object, it is proposed according to the invention that on the end of the torch body facing the nozzle, two support surfaces opposite each other are available which are provided for holding the counter surfaces of a spring loaded clamping bushing which holds the nozzle.

It is advantageous according to the invention that the support surfaces and/or counter surfaces are bevel shaped.

By using a spring loaded clamping bushing and in cooperation with the bevels provided on the support or counter surfaces, the nozzle can be fastened in a simple way to the related end of the torch body whereby it is guaranteed that as a result of the uniform pressure loading of the nozzle by the clamping bushing, an uneven alignment of the nozzle to the torch body axis does not take place so that the nozzle is connected gas-tight to the torch body.

In the preferred embodiment of the invention, it is provided that the bevel is shaped in two parts and consists of an oppositely directed ascending and descending bevel. Because of this oppositely directed ascending and descending bevel which forms the shape of a roof, it is immaterial whether the clamping bushing is rotated clockwise or counterclockwise since the oppositely directed bevels guarantee that they always come in contact with the support surfaces of the torch body independent of the direction of rotation.

Furthermore, it is provided according to the invention that the clamping bushing consists of a main body which has the bevels, in the center of which a set of springs is arranged. This set of springs effects in cooperation with the bevels always a tight arrangement of the nozzle to the torch body whereby even certain wear phenomena of the support and counter surfaces as a result of frequent nozzle changes are compensated.

According to the invention it is, furthermore, advantageous when a central bore for guiding the nozzle head is provided in the end of the torch body which is to hold the nozzle.

In this respect, it is therefore especially favorable when at least one adjusting spring is arranged in the bore edge, which cooperates with a flat surface on the nozzle head. Because of this special arrangement of an adjusting spring in the holding bore of the torch body and a corresponding flat surface on the nozzle head, it is assured that the nozzle can always only be inserted in such a way that its gas channels are always aligned with the corresponding channels in the torch body. As a result, a perfect transfer of gas from the torch body to the nozzle is assured.

THE DRAWINGS

FIG. 3 is a plan view of the torch body of FIG. 2;

FIG. 4(a) is a cross-sectional view of the clamping bushing according to the invention;

FIG. 4(b) is a side view of the clamping bushing; and

FIG. 5 is a plan view of the bushing of FIG. 4.

DETAILED DESCRIPTION

Figures 1, 1A, 1B:
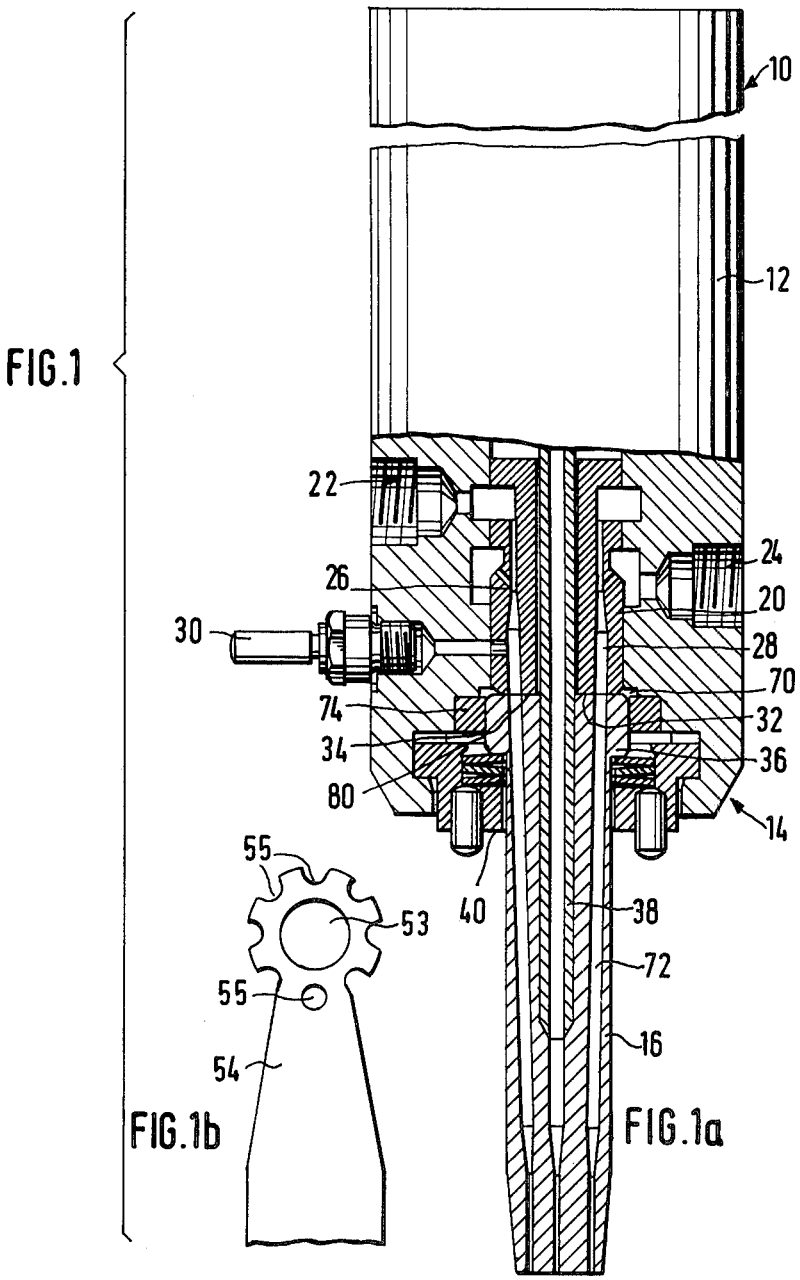
FIG. 1(a) shows a partial cross-sectional view of a torch body according to the invention.
FIG. 1(b) is a wrench for removing the nozzle from the torch body.

FIG. 1 represents a machine mounted torch 10 in partial cross-section, a marking torch is represented in the exemplified embodiment. The machine mounted torch has a torch body 12 (see also FIG. 2), the bottom end 14 of which is designed to hold a powder marking nozzle 16. Instead of powder marking nozzle 16, it is of course also possible and within the scope of the invention to provide a cutting nozzle or the like in a correspondingly designed machine mounted torch.

Mixing of both gases takes place in a mixing position area designated with 26 whereby a separate mixing position is provided for each channel 28.

Ignition of the mixture takes place via an ignition device 30 which is connected to the lower area of the mixer 20.

As can be seen in FIG. 1, the bottom front face 32 of the mixer 20 is flat and accommodates, therefore, in an advantageous manner butt-joining of an equally flat surface 34 of the nozzle head 36.

A tube 38 is centrally provided in the mixer 20, which transports powder from the upper area (not shown) of the torch body 12 to the nozzle 16. In the case of a cutting torch, this tube 38 is replaced with a corresponding cutting oxygen channel.

The nozzle 16 is held in place according to the invention at the lower end 14 of the torch body 12 by means of a clamping bushing 40. This clamping bushing, which is shown by itself as a single unit in FIGS. 4 and 5, has a main body 42. This main body has an originally circular shape in which the ends opposite each other were planned by a parallel cut. In the center of the main body, a stepped bore 44 is provided, the diameter of which corresponds approximately to the shank diameter of the nozzle which must be held by the clamping bushing 40. In the stepped widening 46 of the bore 44, a set of cupsprings 48 is fastened by means of a notched connection 50. The bore diameter of the cupsprings 48 corresponds to that of the bore 44.

In the end of the main body 42 which faces away in the installed position from the torch body 12, two pins 52 are fastened which are opposite each other by 180°.

These pins are designed to hold a wrench 54 shown in connection with FIG. 1, the function of which will still be explained later.

Figure 2:
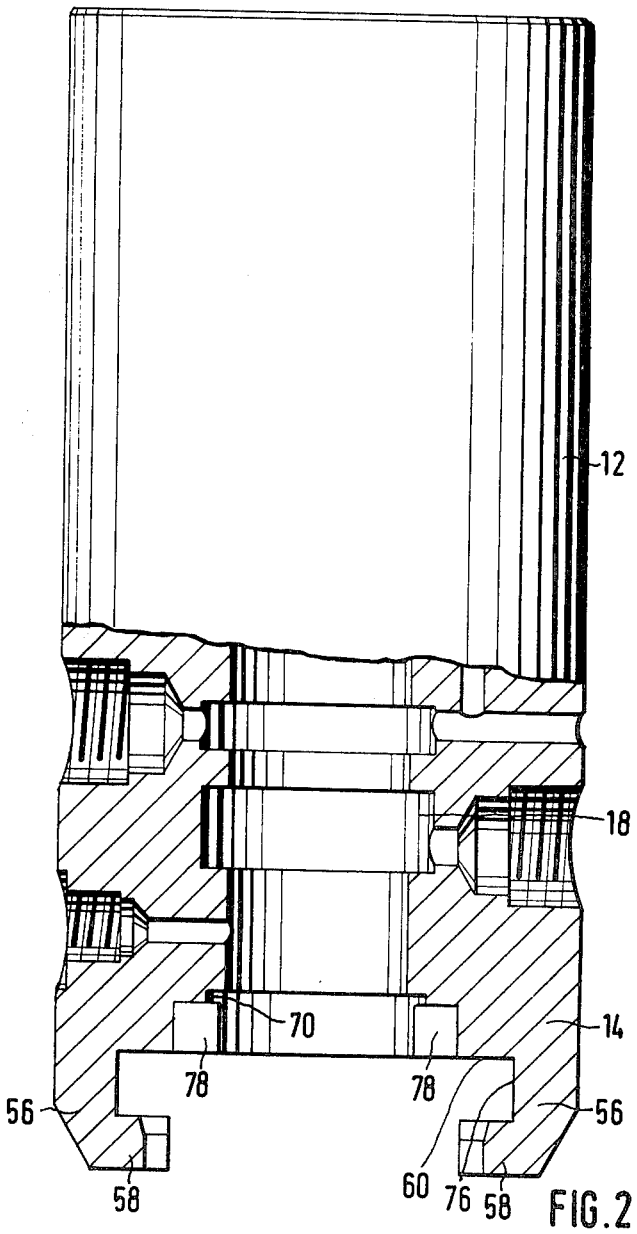
FIG. 2 is a partial cross-sectional view of the torch body itself.

As shown particularly in FIG. 2, the lower end 14 of the torch body 12 is claw-shaped (see also FIG. 3). It can be seen that two opposing (by 180°) circular segment-shaped lugs 56 are provided at the flat end 14 of the torch body 12. Each of these two lugs has a projection 58 which projects inward, see especially FIG. 2, which is spaced from flat surface 60 of the lower end 14 in such a way that an adequate intermediate space remains between these two (58, 50) for the clamping bushing.

The inside of each projection 58 facing the surface 60 forms a support surface 62. These support surfaces are designed to hold corresponding counter surfaces which are formed on the main body 42 of the clamping bushing 40. As the projection of a counter surface drawn on the right in FIG. 4 shows, this is shaped like a bevel, namely like a so-called double-bevel consisting of an ascending bevel 66 and a descending bevel 68 while between these two, the actual horizontal counter surface 64 is provided with which the clamping bushing seats on the corresponding support surfaces 62.

The two bevels 66, 68 have a slope of 10° so that it is immaterial which of the two bevels 66, 68 can be designated as the ascending resp. descending bevel since in fastening the clamping bushing to the torch body, it (40) can be twisted clockwise or counterclockwise in order to fasten in this way the nozzle 15.

As can be especially seen in FIG. 2, the center bore 18 of the torch body 12 has in the area of the surface 60 an enlarged area 70 which is designed to hold and guide the nozzle head 36. Since it is necessary that the channels 28 present in the mixer 20 are aligned with the corresponding channels 72 in the nozzle 16, mixer and nozzle must be aligned with each other.

This takes place by at least one, in the exemplified embodiment two, adjusting springs 74 which are inserted flush with the surface 60 in the bore edge 76. The corresponding recesses for the adjusting springs 74 are designated with 78 in FIG. 2.

As counterpiece to the adjusting springs 74, the nozzle head 36 has two parallel flat surfaces 80 (FIG. 1) opposite each other, which are arranged in such a way that when the nozzle 16 is inserted, the channels 28 of the mixer 20 are aligned with the channels 72 of the nozzle 16, so that an optimal gas transfer from the torch body to the nozzle is guaranteed.

In order to fasten a nozzle 16 to the torch body 12, it is first necessary to insert the nozzle itself into the holding bore 44 of the clamping bushing 40. Inserting the nozzle must take place in such a way that the nozzle shank and the pin 52 point in the same direction as shown in FIG. 1. Then, the nozzle-clamping bushing combination is placed on the wrench 54, in other words, the wrench 54 is slipped by way of its opening 53 over the nozzle 16 until it contacts the clamping bushing 40 and in doing so grasps by means of two recesses 55 which are opposite each other the pins 52. Nozzle and clamping bushing are now introduced with the wrench 54 in the spaced formed between the two lugs 56 which are opposite each other whereby it should be kept in mind that the counter surfaces 64 of the clamping bushing 50 are aligned at an angle of 90° to the support surfaces of the two lugs 56.

Furthermore, it should be kept in mind that the flat surfaces 80 on the nozzle head 36 are aligned parallel to the adjusting springs 74 so that as a result the nozzle head 36 is held tight in the enlarged area 70 of the center bore 18. By lightly compressing the clamping bushing 40 in the direction of the torch body 12 (upward in FIG. 1) and simultaneous rotation of the clamping bushing 40 by means of the wrench 54 clockwise or counterclockwise, the so-called ascending bevels 66 on the main body 42 come now in contact with the corresponding support surfaces 62 of the lugs 56. Determined by the bevel, the clamping bushing 40 is pressed upward during this rotary motion against the action of its springs 48 in FIG. 1 and presses at the same time that the flat surface 34 of the nozzle head 36 gastight against front face 32 of the mixer 20.

When now a 90° rotation of the clamping bushing 40 was carried out with a wrench 54, the support surfaces 62 of the lugs 56 are in contact with the counter surfaces 64 of the clamping bushing 40 (compare the projection of FIG. 4). In this position of the clamping bushing, the nozzle 16 is now fastened gastight to the torch body 12. In order to loosen the nozzle, it is only necessary to rotate the wrench 54 in the same direction of rotation by another 90° or to turn it back by 90°. As a result, the bevels 68 lose contact with the support surface 62 and the nozzle can be withdrawn together with the clamping bushing 40 from the torch body.

In summary, fastening nozzles (which are the parts subject to wear) in torch bodies of a machine mounted torch takes place thus far by means of clamping nuts which are corresponding to the size of the nozzle likewise very large and must be tightened with large wrenches. This poses a problem from a constructive point of view especially in multitorch aggregates in which several nozzles are arranged in the smallest space. The invention provides a simple nozzle fastening by fastening the nozzle to the torch body by means of a special clamping bushing. In this way, a simple nozzle fastening in the torch body is obtained whereby simultaneously a gastight arrangement of the nozzle in the torch body is guaranteed.

What is claimed is:

1. In a machine mounted torch, such as machine mounted cutting torches, marking torches and the like, wherein a torch head has one end to which the torch is arranged in a machine mounting and on the other end to which a nozzle is exchangeably fastened by means of a holding device, the improvement being two support surfaces disposed opposite each other on said end of said torch body facing said nozzle, and said support surfaces holding the counter surfaces of a spring loaded clamping bushing which holds said nozzle.

2. Machine mounted torch according to claim 1, characterized in that at least one of said surfaces and said counter surfaces are bevel shaped.

3. Machine mounted torch according to claim 2, characterized in that said bevel is formed in two parts and consists of an oppositely directed ascending and descending bevel.

4. Machine mounted torch according to claim 3, characterized in that said clamping bushing consists of a main body having a set of springs in the center thereof which has said bevels.

5. Machine mounted torch according to claim 4, characterized in that said set of springs has a center opening to hold said nozzle.

6. Machine mounted torch according to claim 5, characterized in that two pins are provided on the side of said main body facing away from said torch body.

7. Machine mounted torch according to claim 6, characterized in that in the end of said torch body which holds said nozzle is provided with a central bore for guiding the nozzle head.

8. Machine mounted torch according to claim 7, characterized in that at least one adjusting spring is arranged in the bore edge which cooperates with a flat surface on said nozzle head.

9. Machine mounted torch according to claim 2, characterized in that said clamping bushing consists of a main body having a set of springs in the center thereof which has said bevels.

10. Machine mounted torch according to claim 4, characterized in that two pins are provided on the side of said main body facing away from said torch body.

11. Machine mounted torch according to claim 1, characterized in that in the end of said torch body which holds said nozzle is provided with a central bore for guiding the nozzle head.

* * * * *